United States Patent [19]

Garcia

[11] 4,051,997

[45] Oct. 4, 1977

[54] MAIL REMINDER

[75] Inventor: Steve Garcia, Tampa, Fla.

[73] Assignee: James W. Donofrio, Tampa, Fla. ; a part interest

[21] Appl. No.: 546,680

[22] Filed: Feb. 3, 1975

[51] Int. Cl.[2] ..... B65D 91/00

[52] U.S. Cl. ..... 232/35

[58] Field of Search ..... 116/134, 135; 232/34, 232/35

[56] References Cited

U.S. PATENT DOCUMENTS

| | | | |
|---|---|---|---|
| 1,685,874 | 10/1928 | Feist | 232/34 |
| 2,253,461 | 8/1941 | Hoppe | 232/34 |
| 2,484,718 | 10/1949 | McCullar | 232/35 |
| 2,698,712 | 1/1955 | Kreiflow | 232/35 |
| 2,874,896 | 2/1959 | Hickman | 232/35 |
| 3,291,386 | 12/1966 | Van Fleet | 232/35 |
| 3,523,639 | 8/1970 | Wiebe | 232/35 |
| 3,572,581 | 3/1971 | McLeod | 232/35 |

FOREIGN PATENT DOCUMENTS

| | | | |
|---|---|---|---|
| 569,122 | 1/1959 | Canada | 232/34 |

*Primary Examiner*—James T. McCall

*Attorney, Agent, or Firm*—Duckworth, Hobby, Orman, Allen & Pettis

[57] ABSTRACT

A mail reminder device of the type designed to be mounted on a mailbox, comprising a signal including an attachment plate and an indicator movably attached thereto and a flag retractor including an axle and an actuating arm, both the signal and the flag retractor disposed in operative position on the mailbox, whereby one may visually determine whether or not the mailbox has been opened.

4 Claims, 10 Drawing Figures

FIG. 1
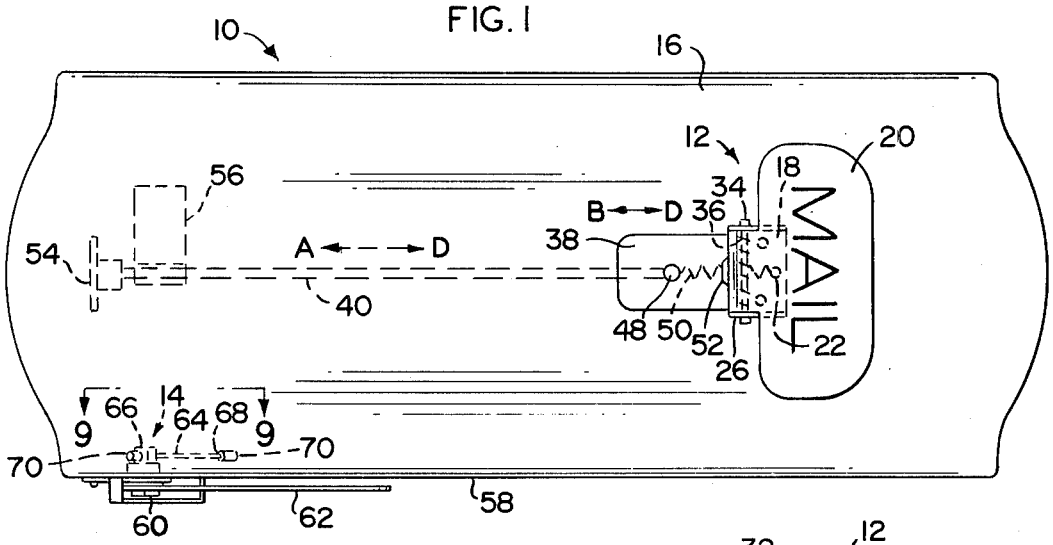
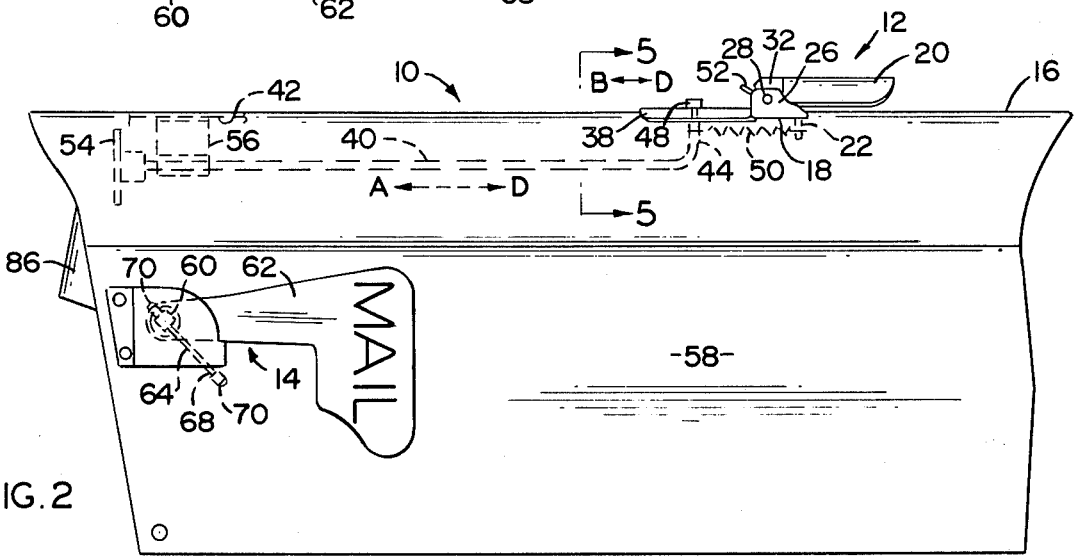
FIG. 2
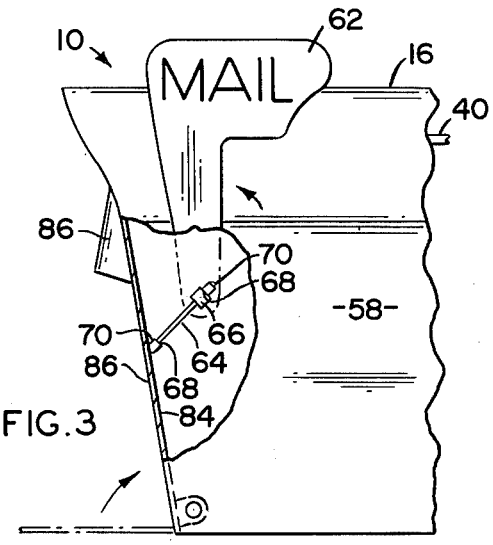
FIG. 3
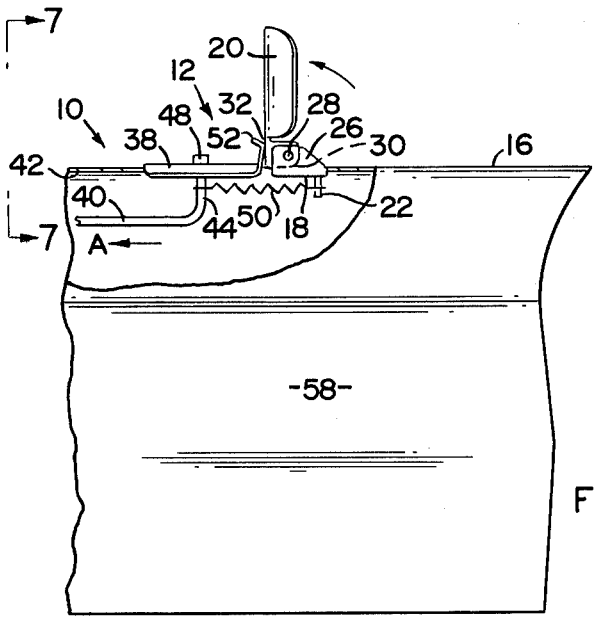
FIG. 4

FIG. 5
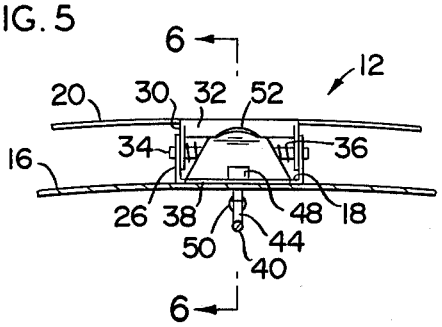
FIG. 7
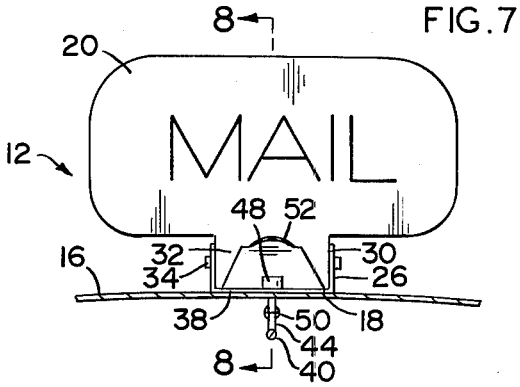
FIG. 6
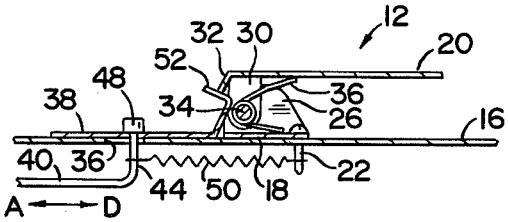
FIG. 8
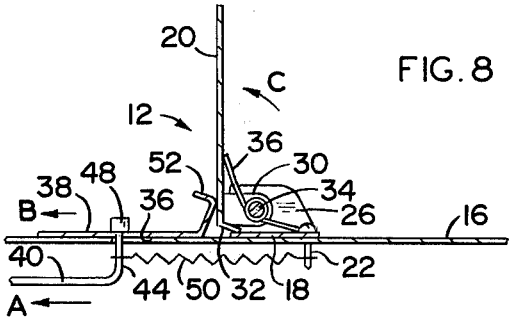
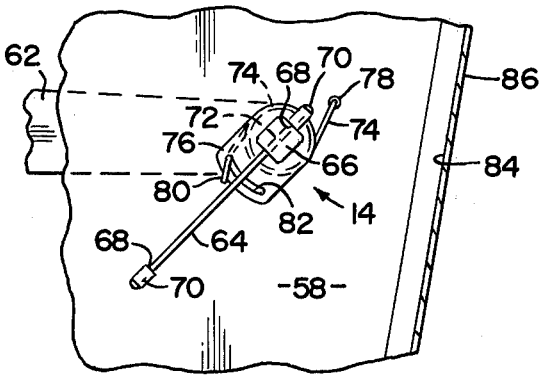
FIG. 9
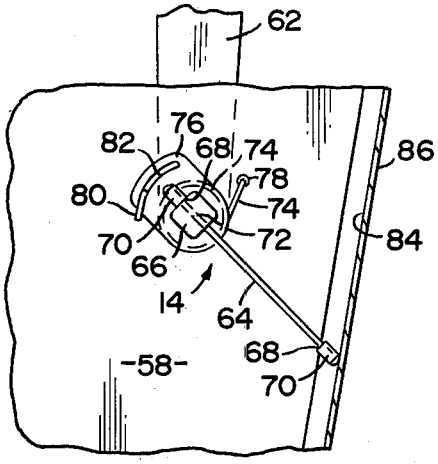
FIG. 10

MAIL REMINDER

BACKGROUND OF THE INVENTION

1. Field of the Invention

This invention relates to a mail reminder device including a plurality of means attached to a post-mounted mailbox, whereby one may visually determine whether or not the mailbox has been opened.

2. Description of the Prior Art

Post-mounted mailboxes of various shapes and designs are in common use today throughout America. While such mailboxes were heretofore commonly associated with rural free delivery of mail, the disappearance of the walking mailman has led to the use of such mailboxes even in urban areas today. The very nature of such mailboxes usually dictates that they are installed at some distance from the residence of the owner. Accordingly, in order to determine whether or not mail has been deposited into the mailbox, it is necessary for the owner to travel some distance and to actually open and look into his mailbox. Of course, such travel must often be made by the owner during periods of inclement weather. While such mailboxes are normally provided with a flag to signal the mailman, there is no corresponding signal to the owner that the mail has deposited mail in the box.

In recognition of this shortcoming of standard, post-mounted mailboxes with various types of devices intended to signal the owner have been devised are are shown in the prior art. However, many of these prior art devices employ constructions involving unnecessarily large numbers of individual parts, thereby increasing the cost of such signal devices. Of course, in addition to increasing costs, large numbers of individual parts also make installation of these prior art devices more complex. Finally, because of the complexity of such prior art devices, they often do not provide reliable service over long periods of time.

Accordingly, it is obvious that there is a great need for a durable, reliable signal device of generally simple, efficient design which is capable of being manufactured at a reasonable price and also of being installed by the average mailbox owner for signaling him when his mailbox has been opened. Of course, such a signal device must also not interfere with normal operation of the mailbox by the mailman, nor violate any regulations of the U.S. Postal Service.

SUMMARY OF THE INVENTION

This invention relates to a mail reminder device of the type designed to be mounted on a mail box which includes means for visually informing the owner of the mailbox that his mailbox has been opened. The device of this invention comprises signal means attached to the top of the mailbox and flag retractor means attached to the mailbox flag.

The signal means comprises an attachment plate and an indicator movably connected to the attachment plate. The attachment plate is mounted on the top of the mailbox by any suitable fastening device, such as screws, bolts, or rivets. Formed on the attachment plate, and extending upwardly away from the top of the mailbox, are two arms whereby the indicator is movably connected to the attachment plate.

The indicator is disposed on the mailbox so that it will not interfere with that portion of the mailbox latch which is normally attached to the mailbox top. Formed at one end of the indicator are two legs which fit within the arms of the attachment plate. The indicator is movably connected to the attachment plate by passing a pin through apertures formed in the arms and the legs. A biasing means, preferably in the form of a spiral spring, is placed around the pin with the opposite extremities in abutting relation to the indicator and the attachment plate respectively, so that the indicator is normally urged in an upward position.

The signal means further comprises signal stop means including a stop plate movably disposed on the mailbox in abutting relation to the base of the indicator. The stop plate is operated by a substantially J-shaped stop arm disposed on the inside of the mailbox top, the curved portion of which extends through an elongated aperture formed in the top of the mailbox and is fixedly attached to a stop plate. The other end of the stop arm includes handle means formed thereon. Finally, stop biasing means are provided to normally urge the stop arm rearwardly, toward the indicator. In a corresponding fashion, this normally urges the stop plate into abutting relation to the base of the indicator, thereby retaining the indicator in a lowered position. When the handle is pulled forwardly, the stop plate is removed from the indicator, and the indicator is lifted into its upward position.

The flag retractor means of the present invention comprises an axle extending through an aperture formed in a side wall of the mailbox and fixedly attached at one end to the mailbox flag, and an actuator arm movably attached to the other end of the axle. The actuator arm comprises a predetermined length of substantially rigid material, and is movably attached to the axle by passing it through an aperture formed in the axle. Retainers are provided at each end of the actuator arm to prevent it from passing completely through the aperture and becoming disconnected therefrom. However, the actuator arm is free to slide back and forth along its longitudinal dimension between the retainers. Finally, flag biasing means are provided on the inside of the mailbox and disposed in substantially surrounding relation to the axle. One end of the flag biasing means is attached to the mailbox, and the other end is attached to the axle so as to normally urge the flag to a lowered position. The actuator arm is of a predetermined length so as to abut the interior surface of the mailbox door when the door is closed and the flag is raised. Because the actuator arm is movably attached to the axle, it will operate to retain the flag in a raised position even when the mailbox door is closed before the flag is raised. It should be obvious that when the mailbox door is opened the abutting relation between the actuator arm and door interior is terminated, allowing the flag biasing means to automatically lower the flag.

Operation of the mail reminder device of the present invention is as follows. The owner depresses the indicator against the top of the mailbox. He then closes the mailbox door and raises the mailbox to an upright position. Of course, if no mail is being placed in the mailbox for the mailman to pick up, it is not necessary to raise the mailbox flag. As the mailbox is opened, the actuator arm of the flag retractor means will no longer abut the interior of the door. Consequently, the force of the flag biasing means will necessarily result in the return of the mailbox flag to its normally lowered position. Thus, the mail reminder device of this invention provides automatic means for informing the owner that his mailbox has been opened. If the mailman is also leaving mail in the box, he pulls the handle of the signal means stop arm, which slides the stop plate forwardly, away from the indicator, allowing the indicator to rise in response to the force applied by its biasing means. Thus, the mail reminder device of the present invention further provides semi-automatic means for informing the owner that mail has been left by the mailman.

It should also be pointed out that in addition to serving as a signal device, the flag retractor means also serves a limited purpose of speeding the delivery of mail. Since, by virtue of the flag retractor means of this invention, the mailman no longer has to manually lower the mailbox flag, less of his time is required in delivering mail. Therefore, less time per delivery is required.

The invention accordingly comprises an article of manufacture possessing the features, properties and the relation of elements which will be exemplified in the article hereinafter described, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which:

FIG. 1 is a top plan view of the invention mounted on a mailbox showing interior details in phantom.

FIG. 2 is an elevational view of the invention shown in FIG. 1.

FIG. 3 is a partial cut-away of a portion of a mailbox showing the flag retractor means with the flag in an upright position.

FIG. 4 is a partial cut-away of a portion of a mailbox showing the signal means in an upright position.

FIG. 5 is a sectional view taken along line 5—5 of FIG. 2.

FIG. 6 is a sectional view taken along line 6—6 of FIG. 5.

FIG. 7 is a sectional view taken along line 7—7 of FIG. 4.

FIG. 8 is a sectional view taken along line 8—7 of FIG. 7.

FIG. 9 is a detail view of a portion of the interior of the mailbox showing the flag retractor means with the flag lowered, taken along line 9—9 of FIG. 1.

FIG. 10 is a detail view similar to FIG. 9 showing the flag retractor means with the flag raised.

Similar reference characters refer to similar parts throughout the several views of the drawings.

DETAILED DESCRIPTION

This invention relates to a mail reminder device of the type designed to be mounted on a mailbox, generally indicated as 10 in FIG. 1, and comprises signal means generally indicated as 12 in FIG. 1, and flag retractor means generally indicated as 14 in FIG. 2. Signal means 12 is attached to top 16 of the mailbox and includes attachment plate 18 and indicator 20.

Attachment plate 18 is mounted to top 16 by means of any suitable fastening device 22, such as screws, bolts or rivets. With reference to FIG. 2, two arms 26 are formed on plate 18 and extend upwardly from top 16. Arms 26 include apertures 28 formed therein. Legs 30 are formed on end 32 of indicator 20 in corresponding relation to arms 26, as best seen in FIG. 4. Legs 30 include apertures (not shown) formed therethrough in corresponding relation to apertures 28 of arms 26. Indicator 20 is movably connected to attachment plate 18 by placing legs 30 within arms 26 and passing pin 34 through apertures 28 and the corresponding apertures formed in legs 30. Indicator 20 is urged toward a normally exposed position by virtue of biasing means 36 placed around pin 34.

Signal means 12 further comprises stop plate 38 movably disposed on top 16 in abutting relation to base 32 of indicator 20. Stop plate means 38 is operated by a substantially J-shaped stop arm 40 which is disposed on the inside 42 of top 16. Curved portion 44 of stop arm 40 extends through an elongated aperture 46 formed in top 16 and is fixedly attached at end 48 to stop plate 38. A stop biasing means 50 is attached in interconnecting relation between curved portion 44 and one of the fastening devices 22 so as to normally urge stop plate 38 in abutting relation to a portion of indicator 20. As best seen in FIGS. 6 and 8, curved end 52 of stop plate 38 is in abutting relation to end 32 of indicator 20. Handle means 54 is formed at the other end of stop arm 40, and stop arm 40 is slidingly retained in substantially parallel relation to inside 42 of top 16 by bracket 56.

By virtue of this construction, indicator 20 is normally maintained in the substantially horizontal position shown in FIG. 6. When, however, the mailman deposits mail in the mailbox, he can notify the owner of this fact by pulling handle means 54 forwardly in the direction indicated by arrows A. This necessarily results in corresponding movement of stop plate 38 as indicated by arrows B. So moving stop plate 38 breaks the abutting relation between curved end 52 and end 32 of indicator 20, allowing biasing means 36 to raise indicator 20 to a substantially vertical position as indicated by arrow C in FIG. 8. To reset the signal means the owner simply depresses indicator 20 to its original horizontal position. Stop biasing means 50 automatically urges stop arm 40 and stop plate 38 rearwardly, as indicated by arrows D, returning the signal means to theposition illustrated in FIG. 6.

As best seen in FIGS. 2, 3, 9 and 10, flag retractor means 14 includes an axle (not shown) extending through an aperture (not shown) formed in side wall 58 of mailbox 10. The axle is fixedly attached at one end 60 to mailbox flag 62, and an actuator arm 64 is movably attached to the other end 66 of the axle. Mounted at each end 68 of actuator arm 64 are retainers 70.

Actuator arm 64 is formed from substantially rigid material, and is movably attached to the axle by passing it through aperture 72 formed therein. Obviously, retainers 70 are utilized to prevent actuator arms 64 from passing completely through aperture 72 and becoming free of the axle. Finally, flag biasing means comprising spring 74 and spring guide 76 are provided on the inside of mailbox 10 between side wall 58 and axle end 66 is substantially surrounding relation to the axle. As best seen in FIGS. 9 and 10, one end 78 of spring 74 is fixedly attached to the side wall 58, while the other end 80 is attached to spring guide 76 by passing end 80 through an aperture 82 formed in spring guide 76. Spring 74 is disposed around the axle in interconnecting relation between side wall 58 and spring guide 76 so as to normally urge flag 62 in the lowered position illustrated in FIG. 9.

Actuator arm 64 is of a predetermined length so as to slide through aperture 20 into abutting relation to the interior surface 84 of door 84 when flag 62 if raised and door 86 is closed. Because actuator arm 64 is movably attached to the axle, arm 64 will operate to retain flag 62 in a raised position even when door 86 is closed before raising flag 62. That is to say, when flag 62 is moved from the position shown in FIG. 9 to that illustrated in FIG. 10, actuator arm 64 slides through aperture 82 until retainer 70 abuts interior surface 84. It should of course be obvious that when door 86 is opened, this abutting relation is terminated, and the normal biasing force of spring 74 is exerted against spring guide 76, causing the axle to rotate and flag 62 to return to its substantially horizontal, lowered position.

In operation, the mail reminder device of this invention is utilized as follows. For purposes of illustration only, it will be assumed that mail is being placed within the mailbox, and therefore, flag 62 will be raised. Of course, it is obvious that the use of flag 62 is not necessary to utilize signal means 12. First, door 86 of mailbox 10 is opened and the outgoing mail is placed within the mailbox. If signal means 12 is in the upright position as shown in FIG. 8, the owner next depresses indicator 20 against top 16 of the mailbox. As previously explained, stop biasing means 50 automatically urges cureved end 52 into abutting relation to end 32, thereby holding indicator 20 in the non-signalling position of FIG. 6. The owner then closes door 86. To indicate the presents of outgoing mail within mailbox 10, the owner then raises flag 62. As flag 62 is raised, end 66 rotates allowing actuator arm 64 to slip therethrough until retainer 70 abuts interior surface 84 of door 86. The mail reminder device of this invention is now set as shown in FIGS. 3 and 4. When the mailman opens mailbox 10, spring 74 automatically lowers flag 62. If the mailman places mail in the mailbox for the owner, he simply pulls handle 54 in the direction of arrows A to raise indicator 20. Thus, the mail reminder of this invention provides an automatic signal to the owner that his mailbox has been opened and a semiautomatic signal that incoming mail has been left by the mailman.

It will thus be seen that the objects made apparent from the preceding description are efficiently attained, and since certain changes may be made in the above description without departing from the scope of the invention, it is intended that all matter contained in the above description or shown in the accompanying drawings shall be interpreted as illustrative and not in a limiting sense.

It is also to be understood that the following claims are intended to cover all of the generic and specific features herein described, and all statements of the scope of the invention which, as a matter of language, might be said to fall therebetween.

Now that the invention has been described, what is claimed is:

1. A mail reminder device of the type designed to be mounted on a mailbox including a flag operatively mounted thereon, said device comprising: a signal means disposed on the top of said mailbox, said signal means comprising an attachment plate fixedly attached to said top, an indicator hingedly connected to said attachment plate, a stop plate movably attached to said top in engaging relation to said indicator, first biasing means disposed in interconnecting relation between said attachment plate and said indicator, whereby said indicator is normally urged toward a substantially perpendicular position with respect to said top, and a stop arm slidingly disposed on the inside of said top, one end of said stop arm being fixedly attached to said stop plate and second biasing means disposed in interconnecting relation between said stop arm and said top inside, whereby said one end of said stop arm and said stop plate are normally urged toward said indicator; and flag retractor means operatively connected to said flag, said flag including axle means movably interconnecting said flag to a side wall of said mailbox, said flag retractor means comprising an actuator arm slidingly attached to one end of said axle on the interior of said mailbox, spring guide means fixedly attached to said axle between said actuator arm and said side wall, and spring means interconnecting said side wall and said spring guide means in substantially surrounding relation to said axle, whereby said flag is normally urged to a lowered position.

2. A device as in claim 1 wherein one end of said stop plate abuts one end of said indicator, when said indicator is held substantially parallel to said top, in blocking relation to said indicator's normally perpendicular position with respect to said top.

3. A device as in claim 1 wherein said actuator arm is slidingly attached to said one end by passing said actuator arm through an aperture formed in said one end, said actuator arm further comprising retainer means formed on each end thereof, said retainer means being relatively larger than said aperture formed in said one end.

4. A device as in clam 1 wherein said actuator arm is of a predetermined longitudinal dimension, one end of said actuator arm sliding into abutting relation to the inside of the mailbox door when said door is closed and said flag is raised.

* * * * *